US007539084B2

(12) United States Patent
Berseth

(10) Patent No.: US 7,539,084 B2
(45) Date of Patent: May 26, 2009

(54) MECHANICAL GOLF COUNTER

(75) Inventor: Vincent Berseth, Neuchâtel (CH)

(73) Assignee: The Swatch Group Research and Development Ltd, Marin (CH)

( * ) Notice: Subject to any disclaimer, the term of this patent is extended or adjusted under 35 U.S.C. 154(b) by 0 days.

(21) Appl. No.: 11/772,594

(22) Filed: Jul. 2, 2007

(65) Prior Publication Data

US 2008/0093435 A1 Apr. 24, 2008

(30) Foreign Application Priority Data

Jun. 30, 2006 (EP) ..... 06116401

(51) Int. Cl.
*G04B 47/00* (2006.01)
*A63B 69/36* (2006.01)

(52) U.S. Cl. ..... 368/10; 473/131; 473/213; 235/1 B; 235/60 C; 235/112

(58) Field of Classification Search ..... 368/278; 235/19–21, 60 C, 1 B, 108–114; 473/131, 473/213

See application file for complete search history.

(56) References Cited

U.S. PATENT DOCUMENTS

| | | | | |
|---|---|---|---|---|
| 1,501,398 | A * | 7/1924 | Eacrett | 235/113 |
| 1,548,941 | A * | 8/1925 | Giset | 235/91 PR |
| 1,920,394 | A * | 8/1933 | Jeanneret | 235/117 A |
| 1,944,629 | A * | 1/1934 | Beach | 235/111 |
| 2,145,018 | A * | 1/1939 | Tweedale | 368/48 |
| 6,543,681 | B1 * | 4/2003 | Wiederrecht et al. | 235/60 C |
| 7,457,201 | B2 * | 11/2008 | Jaermann et al. | 368/10 |
| 2005/0259519 | A1 * | 11/2005 | Muller | 368/80 |

FOREIGN PATENT DOCUMENTS

| | | |
|---|---|---|
| DE | 3816713 A1 | 11/1989 |
| EP | 1 099 459 A1 | 5/2001 |
| GB | 309613 | 4/1929 |
| GB | 310401 | 4/1929 |
| WO | 00/54116 | 9/2000 |

OTHER PUBLICATIONS

European Search Report issued in corresponding application No. EP 06 11 6401, completed Jan. 9, 2007.

* cited by examiner

*Primary Examiner*—Vit W Miska
*Assistant Examiner*—Sean Kayes
(74) *Attorney, Agent, or Firm*—Griffin & Szipl, P.C.

(57) ABSTRACT

A mechanical golf counter includes a case in which is mounted a golf counter mechanism including: a plurality of first components for counting score associated with a plurality of holes and for providing indication of the score at each hole; a plurality of second components for storing the indication for each hole and cooperating with the first components; third component for altering the score indication of a selected hole, cooperating with the first component; fourth component for reading the score of the selected hole, and cooperating with the first components; and fifth component for displaying the score of the selected hole, the fifth component cooperating with the fourth component, wherein the first components are mounted mobile inside the case so any one of the components can occupy a determined score incrementing/reading position, in which the component is selected to cooperate with the third and fourth components.

22 Claims, 4 Drawing Sheets

MECHANICAL GOLF COUNTER

This application claims priority from European Patent Application No. EP 06116401.8, filed Jun. 30, 2006, the entire disclosure of which is incorporated herein by reference.

FIELD OF THE INVENTION

The present invention relates to the field of mechanics and horology. It concerns more specifically a mechanical golf counter able to be integrated in a mechanical watch.

BACKGROUND OF THE INVENTION

Such golf counters have already been disclosed, particularly in GB Patent Nos. 309 613 and 310 401. These documents disclose mechanical golf counters, simultaneously displaying the score at all of the holes, but not allowing display of the time, because of their design. In parallel, there exist watches fitted with mechanical golf counters that display the score at the hole being played and the total score. This type of watch is certainly very useful for the golfer. However, the information concerning the number of strokes played for a hole is lost at the next hole. The player thus cannot return to the number of strokes played for a given hole and analyse his round hole by hole. Such devices are disclosed in EP Patent No. 1 099 459 and WO 00/54116.

SUMMARY OF THE INVENTION

The present invention overcomes these drawbacks by proposing a mechanical golf counter fitted with a device for counting and storing the score at each hole, and a device for displaying the score at any selected hole.

More specifically, the invention concerns a mechanical golf counter comprising a case in which there is mounted a golf counter mechanism including:

- a plurality of first means for counting a score associated with a plurality of holes, and able to provide an indication of the score at each hole, and
- a plurality of second means able to store this indication for each hole, and cooperating with the first means, the golf counter mechanism being characterized in that it further comprises:

- third means able to alter the indication of the score of a selected hole, the third means cooperating with the first means,
- fourth means able to read the score of the selected hole, the fourth means cooperating with the first means,
- fifth means able to display the score of the selected hole, the fifth means cooperating with the fourth means, the golf counter mechanism being further characterized in that the first means are mounted so as to move inside the case such that any one of the means can occupy a determined score incrementing/score reading position, wherein the means is selected to cooperate with the third and fourth means.

Owing to the fact that the means for counting the score at each hole are mounted mobile inside the case, and that each of them can be brought into a position for modifying, reading and displaying the score, the dial of the golf counter according to the invention is not wastefully occupied by the display of the score at each hole, and consequently it can be used for displaying the time. The golf counter according to the invention can thus easily be integrated into a watch.

BRIEF DESCRIPTION OF THE DRAWINGS

Other features and advantages of the present invention will appear more clearly from the following detailed description of an example embodiment of a watch according to the invention, this example being given purely by way of non-limiting illustration, in conjunction with the annexed drawings, in which.

DETAILED DESCRIPTION OF ILLUSTRATIVE EMBODIMENTS

Figure 1:
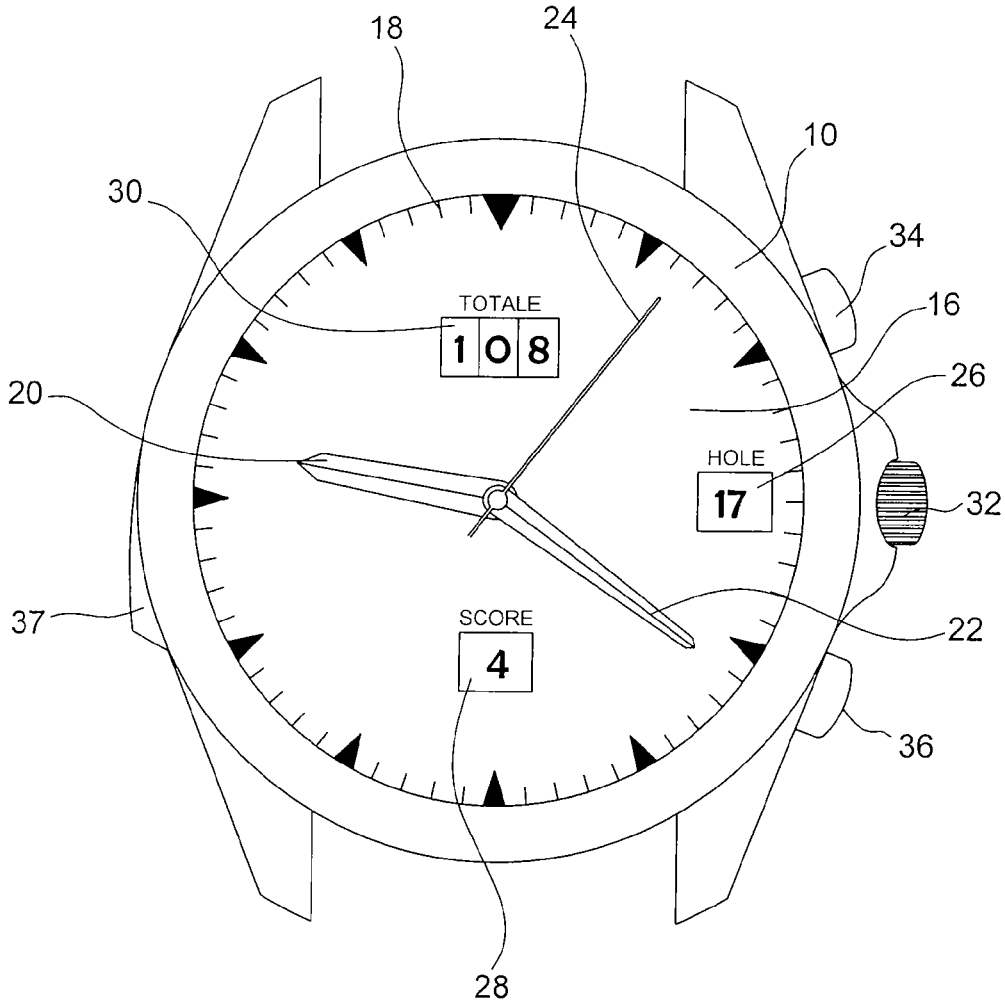
FIG. 1 is a top view of the golf counter according to the invention.
Figure 2:
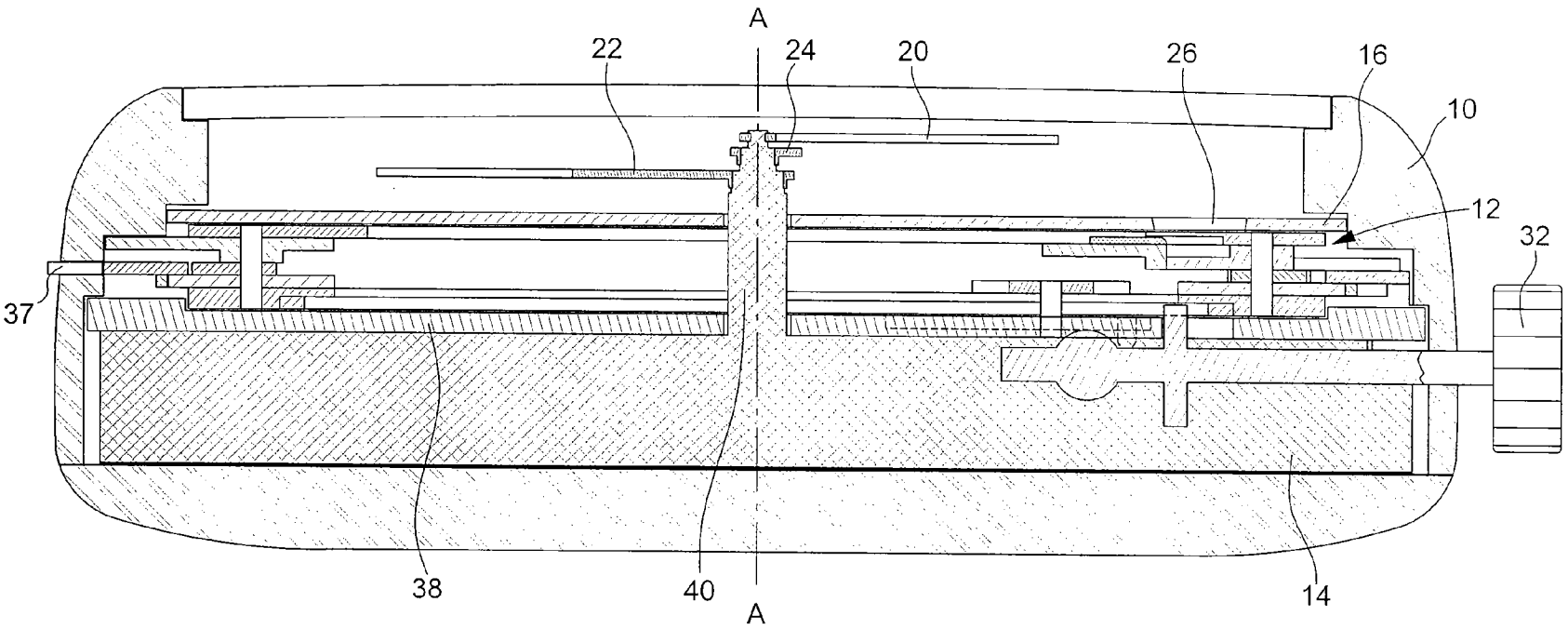
FIG. 2 is a cross-section of the golf counter according to the invention.

The golf counter mechanism illustrated in FIGS. 1 and 2 conventionally comprises a case 10 enclosing a golf counter mechanism 12. In the embodiment shown in FIGS. 1 and 2, the mechanical golf counter further includes a movement 14 above which a dial 16 is mounted, the dial bearing a time display graduation 18 cooperating with hour 20, minute 22 and second 24 hands driven by movement 14. Of course, in a variant of this embodiment, movement 14 could be absent from the golf counter.

The dial 16 includes a first aperture 26 showing a hole number, for example the hole being played, a second aperture 28 corresponding to the score at that hole and a third aperture 30 through which the total score is visible. The case is fitted with a crown 32 located at 3 o'clock for selecting a given hole, two push-buttons 34 and 36 respectively located at 2 o'clock and 4 o'clock, respectively for incrementing and decrementing the score of the selected hole and the total score, and a lever 37 for resetting the score at each hole to zero.

Movement 14 of the mechanical golf counter is conventionally mounted in case 10. Golf counter mechanism 12 is placed above movement 14. For this purpose, it comprises a plate 38 of axis AA fixedly mounted in case 10. In the embodiment illustrated in FIG. 2, plate 38 is secured to case 10. In a variant, plate 38 could be secured to movement 14, which would itself be fixedly mounted in case 10. The dial 16 is mounted above the mechanism 12 the dial 16 being attached to case 10. A central arbour 40 associated with movement 14 and carrying hands 20, 22 and 24 passes through mechanism 12 and dial 16.

Figure 3:
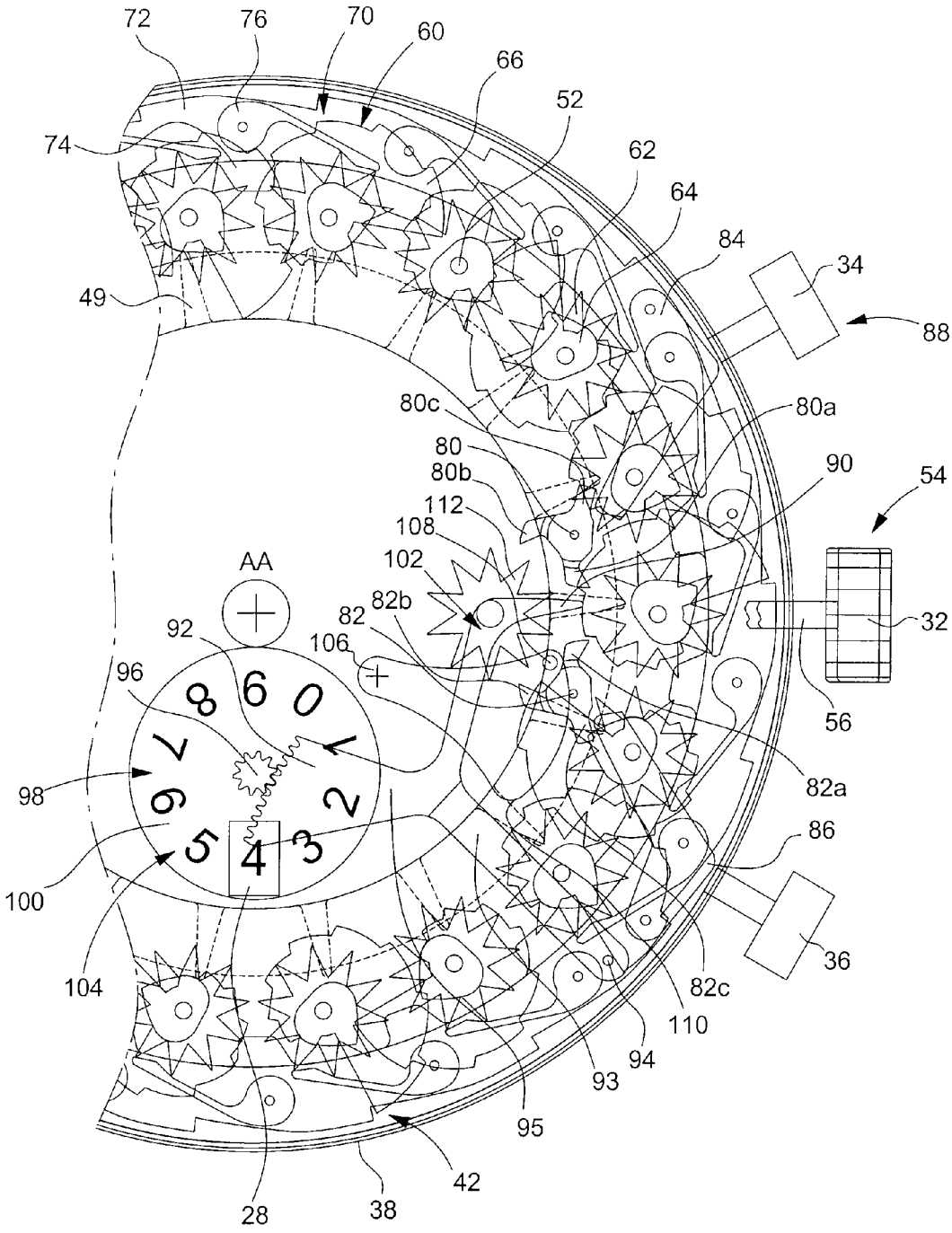
FIG. 3 is a top view of the golf counter mechanism fitted to the golf counter according to the invention.
Figure 4:
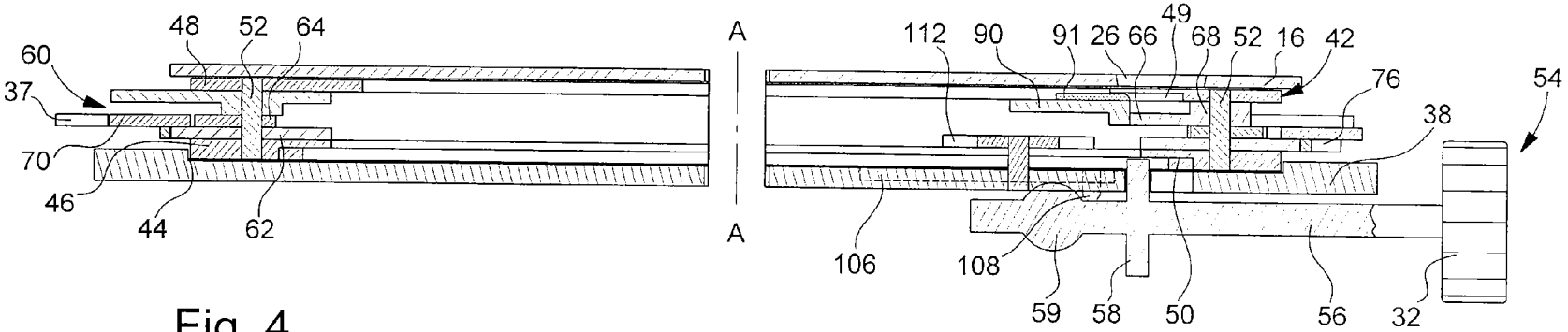
FIGS. 4 and 5 are cross-sections along 9 o'clock-3 o'clock and 2 o'clock-8 o'clock of the mechanism.
Figure 5:
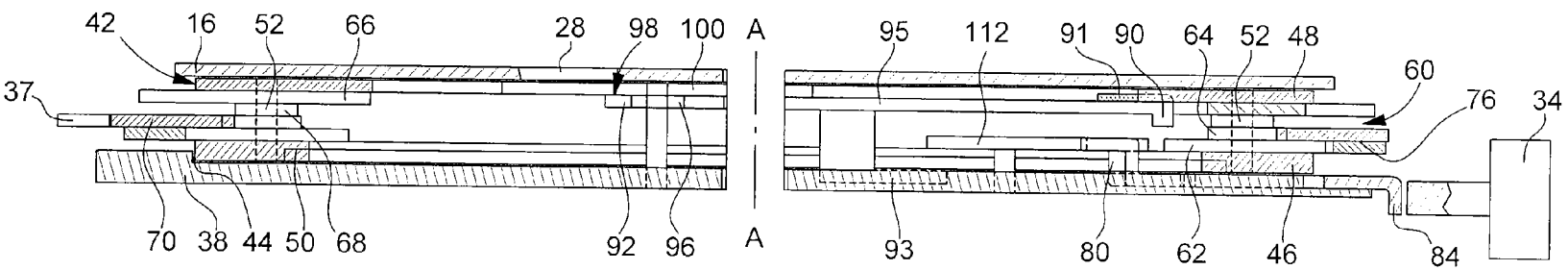

Golf counter mechanism 12 is shown in more detail in FIGS. 3, 4 and 5, and includes a plurality of first means for counting a score associated with a plurality of holes and that are able to provide an indication of the score at each hole played. It comprises the fixed plate 38 of axis AA, and a plate 42 mounted mobile in rotation about axis AA, on fixed plate 38. For this purpose, fixed plate 38 is fitted with a circular housing 44 located on the top face thereof. Moreover, mobile plate 42 is formed of a bottom plate 46 and a top plate 48, both hollowed at the centre. Top plate 48, located directly underneath dial 16, bears the hole numbers, visible through aperture 26. It is, further, provided with a plurality of notches 49, distributed on the inner periphery thereof, the function of which will appear hereinbelow. Bottom plate 46 is provided with a contrate toothing 50 located on the bottom face thereof. The bottom and top plates 46 and 48 are secured to each other via a plurality of arbours 52 distributed in a circle and secured by a first end to bottom plate 46, and by a second end to top plate 48. Bottom plate 46 is arranged in a housing 44, such that plate 42 is positioned radially while being guided in rotational movement. Plate 42 is controlled in rotation by a control member 54 located at 3 o'clock and formed of a stem 56 on which the crown 32 and a pinion 58 are mounted. Control member 54 is arranged in case 10 such that pinion 58 meshes with contrate toothing 50 in the pulled out position, and rotates freely in the pushed-in position. Stem 56 extends beyond pinion 58 and further comprises a protruding circular portion 59, the function of which will be explained hereinbelow.

Arbours 52, 18 in number, each correspond to one hole of the golf course and to a number of the numbering of top plate 48. A simplified variant of this embodiment could be limited to 9 arbours, for a 9-hole golf course. On each arbour 52, there is mounted a wheel set 60 formed, from bottom plate 46 to top plate 48, of a star wheel with ten teeth 62, a heart-piece 64 and a snail 66, the various elements being superposed and secured to each other. At the heart of the same wheel set 60, star 62, heart-piece 64 and snail 66 are orientated relative to each other such that the tip of heart-piece 64 is aligned with one tooth of star wheel 62 and the portion of snail 66 with the largest radius. Each snail 66 is further provided with a wedge 68 secured to the bottom face or top face thereof, such that it extends respectively into a top or bottom level. Two neighbouring snails 66 extend into two different levels, which enables wheel sets 60 to be moved closer without snails 66, which form the widest part of wheel set 60, colliding with each other. Thus, the first means includes, among various other interacting components, a wheel set 60 formed of a star wheel 62, a heart-piece 64, and a snail 66. As evident from FIG. 3, there are eighteen first means in the embodiment illustrated by FIG. 3.

A ring 70 is inserted, at the periphery of counter mechanism 12, between star wheels 62 and snails 66, in the plane of heart-pieces 64. It is provided with eighteen symmetrically teeth 72 for cooperating with reset lever 37, as will appear hereinbelow. It comprises, directed towards heart-pieces 64, eighteen protruding portions 74 forming hammers for orientating wheel sets 60 for resetting the score at each hole to zero. Moreover, it is provided with 18 jumper springs 76 secured to the bottom face thereof, each jumper spring 76 cooperating with one star wheel 62 in order to position the same. When plate 42 is being driven in rotation, ring 70 is itself driven in rotation owing to the friction forces exerted by the eighteen star wheels on the eighteen jumper springs.

The wheel set 60 located at 3 o'clock is the wheel set corresponding to the selected hole. In this position, wheel set 60 can be activated in order to increment the score of the selected hole and enable the score to be read. This will be called the incrementing/reading position in the following text. In order to increment the score, two respectively incrementing and decrementing wheel sets 80 and 82, each provided with two beaks, respectively 80*a*, 80*b* and 82*a*, 82*b* and one finger, respectively 80*c* and 82*c*, are mounted in fixed plate 38, in proximity to the star wheel 62 located in the incrementing/reading position, on either side of the 9 o'clock-3 o'clock diameter. The beaks 80*a*, 80*b*, 82*a* and 82*b* are located in the plane of star wheel 62, whereas fingers 80*c* and 82*c* extend in the plane of fixed plate 38. Wheel sets 80 and 82 are activated by two levers, respectively 84 and 86, pivotably mounted in fixed plate 38. These levers 84 and 86 extend in the plane of fixed plate 38 so as to cooperate respectively with fingers 80*c* and 82*c*. They are respectively activated by push-buttons 34 and 36. Push-buttons 34, 36, levers 84, 86 and wheel sets 80, 82 form, with star wheels 62, a device 88 for incrementing/decrementing the score of the selected hole.

Golf counter mechanism 12 further comprises a feeler-spindle 90 that rests on snail 66 in the incrementing/reading position. The end thereof extends on the bottom and top levels of snails 66 so as to come into contact with any of them. It further possesses a beak 91 extending into the plane of top plate 48 and for cooperating with notches 49 in order to block mobile plate 42, as will appear hereinbelow. Feeler spindle 90 is secured to a rack 92 pivotably mounted about an arbour 94 in fixed plate 38 and comprising a first portion 93 extending into the plane of plate 38 and a second portion 95 extending into the plane of feeler spindle 90. The assembly of feeler spindle 90-rack 92 (i.e., a second means able to store the indication for each hole) is subjected to the action of a return spring that is not shown, tending to hold feeler spindle abutting on the snail 66 in the incrementing/reading position. Rack 92 meshes with a pinion 96 mounted in fixed plate 38. Wheel set 98 comprises, in addition to pinion 96, a disc 100 for displaying the score of the selected hole located opposite aperture 28. Feeler spindle 90 forms a device 102 for reading the score of the selected hole (i.e., a fourth means for reading the score of the selected hole), whereas rack 92 forms, with wheel set 98, a device 104 for displaying this score (i.e., a fifth means for displaying the score of the selected hole).

A substantially triangular cam 106, extending into the plane of fixed plate 38, is pivotably mounted thereon, It comprises a stop member 108, located on an apex of the triangle and extending axially towards movement 14, and a rounded protruding portion 110 substantially forming another triangle apex and for cooperating with the portion 95 of rack 92. Cam 106 is subjected to the action of a return spring that is not shown, tending to keep stop member 108 abutting against the stem 56 of control member 54. In this position, protruding portion 110 does not come into contact with rack 92, whatever the position of the latter.

Golf counter mechanism 12 includes finally a star wheel 112 mounted in fixed plate 38 in proximity to star wheel 62 in the incrementing/reading position, on the 9 o'clock-3 o'clock diameter, and extending into the plane of star wheel 62. In this position, star wheel 112 can be actuated by beak 80*b* and 82*b* of wheel sets 80 and 82 respectively. Star wheel 112 forms the first element of an adder that is not otherwise shown in greater detail, of the type disclosed in GB Patent No. 310 401. The adder is associated with a display device for displaying the total score through aperture 30. Mechanism 12 also includes, optionally, a device for resetting the score to zero, of the type presented in GB Patent No. 310 401.

Golf counter mechanism 12 operates as follows:

In the initial position, the wheel set 60 corresponding to the first hole is in the incrementing/reading position, and hole number 1 can be seen through aperture 26. Moreover, wheel sets 60, which provided, via their angular position, an indication of the hole score, are orientated such that snail 66 points towards the AA axis, which corresponds to a score of zero. In this position, aperture 28, associated with the score of the selected hole, display a score of zero. Likewise, aperture 30 associated with the total score, displays a score of zero. It will also be noted that the rotating plate 42 is blocked in rotation owing to beak 91, which is engaged in the notch 49 of plate 48 corresponding to this initial position.

An application of pressure on push-button 34 activates lever 84, which drives incrementing wheel set 60 in rotation via finger 80*c*. Beak 80*a* abuts on one tooth of star wheel 62 in the incrementing/reading position, and the latter rotates by one tooth via jumper spring 76. The score of the selected hole, which is linked to the angular position of wheel set 60, is thus incremented by one point. At the same time, beak 80*b* abuts on one tooth of star wheel 112, and the latter rotates by one tooth, driving the adder. The total score is thus incremented by one point.

In the initial position, feeler spindle 90 abuts on the portion of snail 66 that has the largest radius in the incrementing/reading position. When wheel set 60 rotates via the effect of an application of pressure on push-button 34, snail 66 presents a smaller radius to feeler spindle 90, which causes the feeler spindle 90-rack 92 assembly to swing about its pin 94. Rack 92 in turn drives wheel set 98 in rotation via pinion 96 and the display of the first hole score passes from 0 to 1.

Repeated applications of pressure on push-button 34 thus increment and display the score of the first hole and the total score. It will be noted that it is possible to correct these scores via push-button 36. Indeed, the action of push-button 36, associated with lever 86 and wheel set 82, is symmetrical with the action of push-button 34. Push-button 36 thus rotates star wheels 62 and 112 in the opposite direction to the incrementing direction, which decrements the scores. Thus, a third means for altering the score indication of a selected hole is provided by push-buttons 34, 36, levers 84, 86, and wheel sets 80, 82 in cooperation with star wheels 62.

Passage from the first hole to the second hole is achieved by using control member 54 in the pulled-out position. In this position, protruding portion 59 present on stem 56 is positioned opposite the stop member 108 belonging to cam 106, which has the effect of pivoting cam 106 about its axis. Protruding portion 110 then abuts on rack 92 so as to cause it to pivot about its axis 94. Feeler spindle 90 is thus moved away from snail 66, and beak 91 leaves notch 49, which unblocks plate 42. When the operator activates control member 54, mobile plate 42 is driven in rotation and the wheel set 60 corresponding to the second hole is brought into the incrementing/reading position. Aperture 26 then shows the number 2, and a score of zero is displayed through the aperture 28 associated with the score of the selected hole. The second hole score and total score are altered using push-buttons 34 and 36 as explained previously.

The operations described previously are then repeated until the last hole.

It should be noted that as the angular position of wheel sets 60 is fixed, owing to jumper springs 76, the score at each hole played is stored when the user passes to the next hole. It is thus possible, at any time, to consult the score of a hole that has already been played, by moving plate 42 using crown 32 so as to position a determined wheel set 60 in the incrementing/reading position. Since the score has been stored using jumper spring 76, feeler spindle 90 reads this score and transmits it to display device 104.

At the end of a round, the scores of the holes played are reset to zero using ring 70. This latter is activated using the zero reset lever 37, which cooperates with the asymmetrical teeth 72 to drive the lever in rotation. Hammers 74 then return all of heart-pieces 64 to their initial position, i.e. with the point thereof pointed towards the AA axis. Wheel sets 60 are thus all reoriented so as to provide a zero score reading.

The invention claimed is:

1. A mechanical golf counter including a case in which is mounted a golf counter mechanism including:

(a) a plurality of first means for counting a score associated with a plurality of holes, and able to provide an indication of the score at each hole;

(b) a plurality of second means for storing the score indication for each hole, and said plurality of second means cooperate with said plurality of first means;

(c) third means for altering the score indication of a selected hole, wherein said third means cooperate with said plurality of first means;

(d) fourth means for reading the score of said selected hole, said fourth means cooperating with said plurality of second means; and (e) fifth means for displaying the score of said selected hole, wherein said fifth means cooperates with said fourth means, wherein each of said plurality of first means and each of said plurality of second means includes an axis of rotation, and said plurality of first means and said plurality of second means are mobily mounted inside the case so that each axis of rotation is able to move along a circular path with respect to said case so that any one of said plurality of first means and said plurality of second means can be brought at any time to occupy a determined score incrementing/reading position with respect to said third means and said fourth means, in which said plurality of first means and plurality of second means are selected to cooperate with said third means and said fourth means so that the mechanical golf counter is operable to display, using the fifth means, the score of a first hole that has already been played or the score of a second hole that is currently being played.

2. The mechanical golf counter according to claim 1, wherein said golf counter mechanism further includes an adder.

3. The mechanical golf counter according to claim 1, further including a movement mounted in said case.

4. The mechanical golf counter according to claim 1, wherein said first means are formed of wheel sets each providing an indication of the score at one hole, and wherein said wheel sets are mounted on a first plate being mounted mobile in rotation inside the case so as to cause the wheel sets to pass in succession into said determined incrementing/reading position.

5. The mechanical golf counter according to claim 4, wherein said first plate rotatably mounted inside said case is provided with a contrate toothing, and wherein said control member includes a stem, a crown mounted on a first end of said stem and a pinion mounted on a second end of said stem, said pinion meshing with said contrate toothing.

6. The mechanical golf counter according to claim 4, wherein said golf counter mechanism further includes means for decrementing the score provided by said wheel set in the incrementing/reading position.

7. The mechanical golf counter according to claim 6, wherein said decrementing means include a decrementing wheel set fixedly mounted on a second plate and fitted with a beak cooperating with a star wheel in the incrementing/reading position, a second lever pivotably mounted on said second plate and cooperating with said decrementing wheel set so as to rotate the same, and a second push-button mounted in said case and cooperating with said second lever so as to pivot the same, said decrementing means, second lever and second push-button being symmetrically mounted relative to the wheel set in the incrementing/reading position or respectively to the incrementing wheel set, first lever and first push-button.

8. The mechanical golf counter according to claim 4, wherein said golf counter mechanism further includes a second plate fixedly mounted in the case and on which said first plate is mounted so as to move in rotation.

9. The mechanical golf counter according to claim 8, wherein said wheel sets include a star wheel and a snail secured to said star wheel.

10. The mechanical golf counter according to claim 4, wherein said first plate is actuated by a rotation control member.

11. The mechanical golf counter according to claim 10, wherein said golf counter mechanism further includes a second plate fixedly mounted in the case and on which said first plate is mounted so as to move in rotation.

12. The mechanical golf counter according to claim 10, wherein said wheel sets include a star wheel and a snail secured to said star wheel.

13. The mechanical golf counter according to claim 4, wherein said wheel sets include a star wheel and a snail secured to said star wheel.

14. The mechanical golf counter according to claim 13, wherein said third means is operable to alter the score indication of a selected hole and includes an incrementing wheel set fixedly mounted on said second plate and provided with a beak cooperating with said wheel set in the incrementing/reading position, a first lever pivotably mounted on said second plate and cooperating with said incrementing wheel set so as to rotate the same, and a first push-button mounted in said case and cooperating with said first lever so as to pivot the same.

15. The mechanical golf counter according to claim 13, wherein said fourth means is able to read the score of said selected hole and includes a feeler spindle pivotably mounted on said second plate and cooperating with said snail in the incrementing/reading position.

16. The mechanical golf counter according to claim 15, wherein said fifth means is able to display the score of said selected hole and includes a rack secured to said feeler spindle, and a wheel set formed of a pinion and a display disc, said rack meshing with said pinion.

17. The mechanical golf counter according to claim 15, wherein said feeler spindle further includes a beak and wherein said first plate includes a plurality of notches, said beak cooperating with said notches so as to block said first plate in rotation.

18. The mechanical golf counter according to claim 13, wherein said second means is able to store said indication for each hole and includes an elastic member cooperating with said star wheel so as to position the same.

19. The mechanical golf counter according to claim 18, wherein said wheel sets further include a heart piece inserted between said star wheel and said snail and secured to said star wheel and to said snail.

20. The mechanical golf counter according to claim 19, wherein said elastic member mounted on a ring inserted between said star wheel and said snail, said ring further including a hammer cooperating with said heart piece so as to orientate the same.

21. A mechanical golf counter including a case in which is mounted a golf counter mechanism, the golf counter mechanism including:

(a) a plurality of first assemblies for counting a score associated with a plurality of holes, wherein each first assembly comprises a first wheel set that includes a star wheel operably connected to a heart-piece member and a snail member, wherein the plurality of first assemblies are operable to provide an indication of the score at each hole;

(b) a plurality of second assemblies for storing the score indication for each hole, wherein each second assembly comprises a feeler spindle secured to a rack, and the plurality of second assemblies are disposed to cooperate with the plurality of first assemblies;

(c) a third assembly for altering the score indication of a selected hole, wherein the third assembly comprises a first push-button associated with a first lever and a second wheel set, and the third assembly is disposed to cooperate with the plurality of first assemblies;

(d) a fourth assembly for reading the score of a selected hole, wherein the fourth assembly comprises the feeler spindle connected to a first portion member that is pivotally connected to rotate about an arbour, and the fourth assembly is disposed to cooperate with the plurality of second assemblies; and (e) a fifth assembly for displaying the score of the selected hole, wherein the fifth assembly comprises a third wheel set that includes a pinion operably connected to a disc for displaying score, and the fifth assembly cooperates with the fourth assembly, wherein each first wheel set and each of the plurality of second assemblies includes an axis of rotation, and the plurality of first assemblies and the plurality of second assemblies are mobily mounted inside the case so that each axis of rotation of each first wheel set and each axis of rotation of each second assembly is able to move along a circular path with respect to the case so that any one of the plurality of first assemblies and the plurality of second assemblies can be selectively disposed to occupy a determined score incrementing/reading position with respect to the third assembly and the fourth assembly, in which the plurality of first assemblies and plurality of second assemblies are selected to cooperate with the third assembly and the fourth assembly so that the mechanical golf counter is operable to display, using the fifth assembly, the score of a first hole that has already been played or the score of a second hole that is currently being played.

22. A mechanical golf counter including a case in which is mounted a golf counter mechanism, the golf counter mechanism including:

(a) a plurality of counting assemblies that count a score associated with a plurality of holes, and that are able to provide an indication of the score at each hole;

(b) a plurality of storing assemblies that store said score indication for each hole, wherein said plurality of storing assemblies are disposed to cooperate with said plurality of counting assemblies;

(c) at least one push button assembly for altering the score indication of a selected hole, wherein said at least one push button assembly cooperates with said plurality of counting assemblies;

(d) a reading assembly operable to read the score of said selected hole, said reading assembly disposed to cooperate with said plurality of storing assemblies; and (e) a display assembly operable to display the score of said selected hole, wherein said display assembly cooperates with said at least one push button assembly, wherein each of said plurality of counting assemblies and each of said plurality of storing assemblies includes an axis of rotation, and said plurality of counting assemblies and said plurality of storing assemblies are mobily mounted inside the case so that each axis of rotation is able to move along a circular path with respect to said case so that any one of said plurality of counting assemblies and said plurality of storing assemblies can be brought at any time to occupy in a determined score incrementing/reading position with respect to said at least one push button assembly and said reading assembly, in which said plurality of counting assemblies and plurality of storing assemblies are selected to cooperate with said at least one push button assembly and said reading assembly so that the mechanical golf counter is operable to display, using the display assembly, the score of a first hole that has already been played or the score of a second hole that is currently being played.

* * * * *